United States Patent [19]

Gioscia

[11] Patent Number: 4,887,401

[45] Date of Patent: Dec. 19, 1989

[54] KNOCK DOWN PARTITION WALL ASSEMBLY

[76] Inventor: Thomas J. Gioscia, 25558 Fedala Rd., Valencia, Calif. 91355

[21] Appl. No.: 182,941

[22] Filed: Apr. 18, 1988

[51] Int. Cl.[4] ..... E04F 17/08

[52] U.S. Cl. ..... 52/221; 52/242

[58] Field of Search ..... 52/241, 242, 238.1, 52/221, 220

[56] References Cited

U.S. PATENT DOCUMENTS

| | | | |
|---|---|---|---|
| 3,013,642 | 12/1961 | Hammitt et al. | 52/238.1 |
| 3,803,787 | 4/1974 | Daggy | 52/241 |
| 3,956,861 | 5/1976 | Rasmussen | 52/717.1 |
| 4,596,098 | 6/1986 | Finkbeiner et al. | 52/241 X |
| 4,631,881 | 12/1986 | Charman | 52/238.1 |
| 4,713,918 | 12/1987 | Cioffi | 52/221 |

*Primary Examiner*—Carl D. Friedman
*Assistant Examiner*—Lan Mai
*Attorney, Agent, or Firm*—Poms, Smith, Lande & Rose

[57] ABSTRACT

A knock down partition wall assembly comprising a base member with built-in adjustable electric connectors. Partition walls snap onto the base member and the horizontal tops thereof are finished off by snap-on moldings. The vertical ends of the partition walls line-up with exposed ends of the base member and these ends are closed off by snap-on end moldings presenting a knock down partition wall assembly.

18 Claims, 4 Drawing Sheets

Fig. 1.
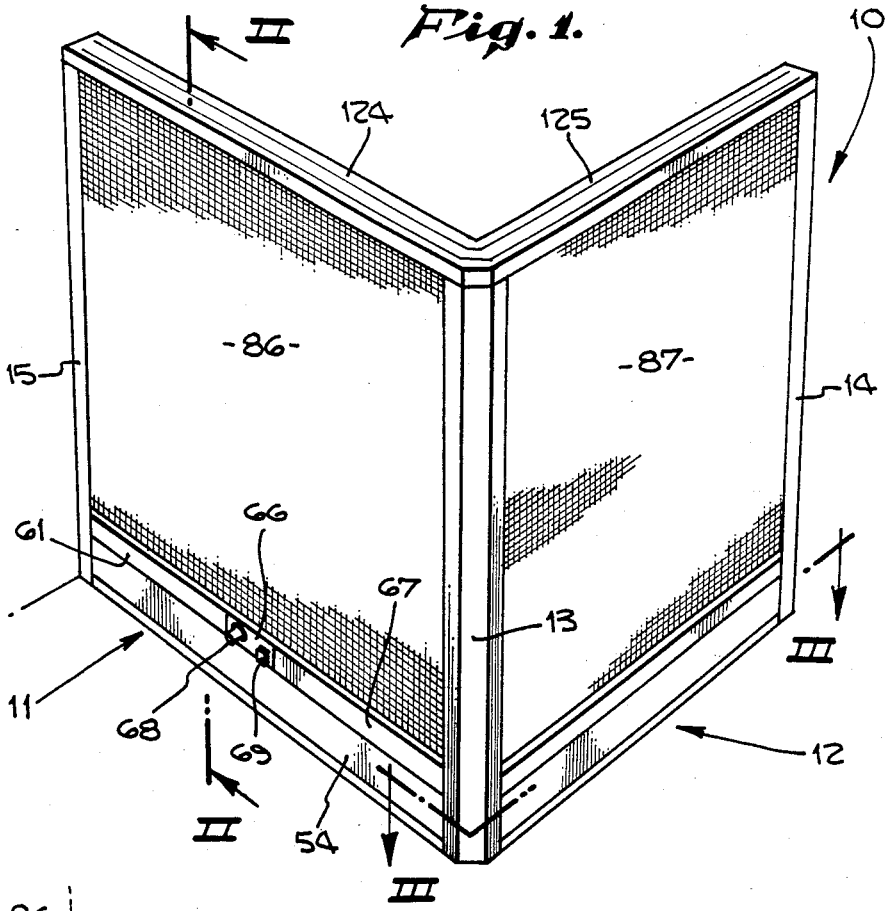
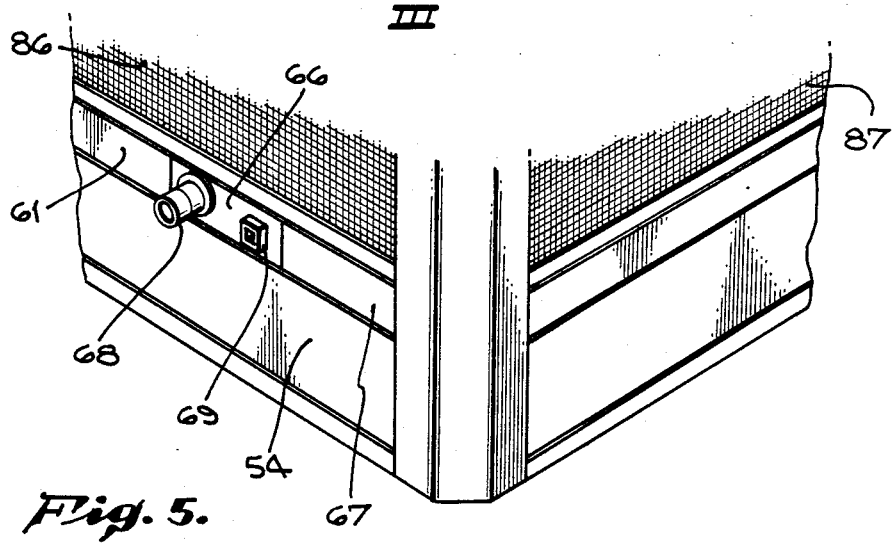
Fig. 5.

KNOCK DOWN PARTITION WALL ASSEMBLY

BACKGROUND OF THE INVENTION

1. Field of the Invention

The invention relates to knock down partition wall assemblies; and, more particularly, to a freestanding wall assembly which can be snapped together or taken apart quickly and easily.

2. Description of the Prior Art

Various types and arrangements have been proposed over the years for quickly and easily setting up and taking down wall assemblies. Many systems are known where extrusions are formed to snap-fit into channel members, as in U.S. Pat. No. 4,397,127 to Mieyal. However, no prior art wall assembly provides for variable spacing electronic outlet connection nor interconnecting means which can be adapted to interlock different parts of the system.

SUMMARY OF THE INVENTION

It is an object of this invention to provide a knock down wall assembly which has separable interlocking sections, the interlocking means being adaptable to different portions of the assembly.

It is another object of this invention to provide a knock down wall assembly having a baseboard with electronic outlets, the spacing of such outlets on the baseboard being variable.

These and other objects are preferably accomplished by providing a knock down partition wall assembly comprising a base member with built-in adjustable electric connectors. Partition walls snap onto the base member and the horizontal tops thereof are finished off by snap-on moldings. The vertical ends of the partition walls line up with exposed ends of the base member and these ends are closed off by snap-on end moldings presenting a knock down partition wall assembly.

BRIEF DESCRIPTION OF THE DRAWING

FIG. 1 is a vertical perspective view of a free standing knock down assembly in accordance with the teachings of the invention;

FIG. 5 is a perspective view of a portion of the assembly of FIG. 1.

DESCRIPTION OF THE PREFERRED EMBODIMENT

Figure 2A:
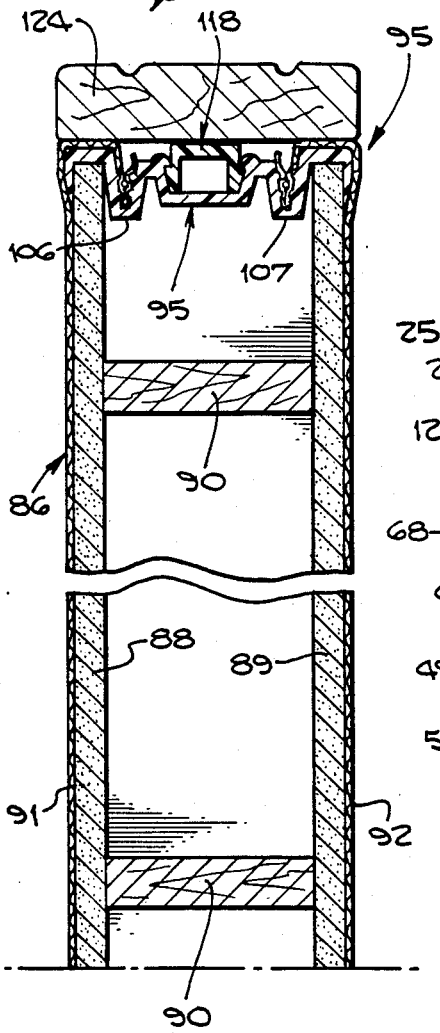
FIGS. 2*a* and 2*b* are sectional views taken along lines II—II of FIG. 1.
Figure 2B:
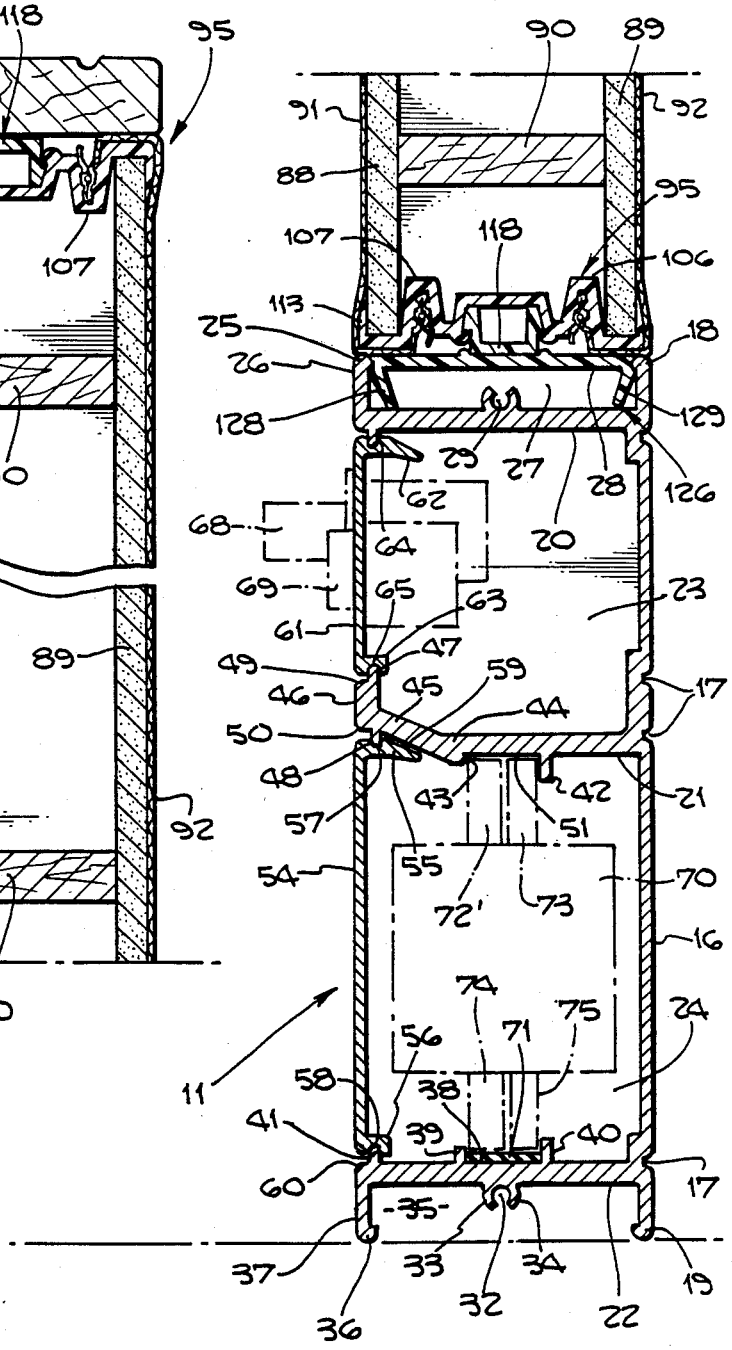

Referring now to FIG. 1 of the drawing, a knock down free standing partition assembly 10 is shown having a pair of horizontal base sections 11, 12, a vertical corner member 13, a pair of vertical end sections 14, 15. Base sections 11, 12 are identical and each section is an elongated extruded metallic unit. As seen in FIG. 2*b*, section 11 includes a generally planar rear wall 16, which may have elongated notches 17 for decorative purposes, terminating at top and bottom in inwardly extending beads 18, 19, respectively.

A plurality of elongated planar partitions 20 to 22 divide base section 11 into upper and lower chambers 23, 24, respectively. Partition 20 is disposed a short distance below bead 18 and a like inwardly extending bead 25 on planar wall portion 26 parallel to that portion of wall 16 between partition 20 and bead 18. This forms a recessed channel 27 for receiving an interconnecting member 28 therein, as will be discussed further hereinbelow. An elongated groove 29, which is generally circular in cross-section and open at the top, is formed by a pair of curved flanges 30, 31 (see also FIG. 7) extending longitudinally along generally the central axis of partition 20. A groove 32, FIG. 2*b*, identical to groove 29, formed by curved flanges 33, 34 (identical to flanges 30, 31), is provided on the bottom of partition 22. Also, a channel 35, identical to channel 27, is formed below partition 22, channel 35 being defined by the lower part of wall 16, partition 22, bead 19, and an inwardly extending bead 36, similar to bead 19, on wall portion 37 extending parallel to the lower part of wall 16.

A groove or channel 38 extends longitudinally along the central axis of partition 22 on the upper surface thereof defined by upwardly extending spaced ribs 39, 40. Groove or channel 38 may be rectangular in cross-section. An elongated bead 41 extends upwardly from partition 22 adjacent wall portion 37.

Partition 21 has a downwardly extending rib 42 spaced from a shoulder 43 formed by an enlarged portion 44 of partition 21 which extends upwardly at an angle thereto forming angled portion 45 terminating at a vertical wall portion 46. A pair of vertical beads 47, 48 extend upwardly and downwardly, respectively, from wall portion 46. As seen in FIG. 2*b*, these beads 47, 48 are offset or spaced inwardly forming channels 49, 50, respectively, for reasons to be discussed.

The shoulder 43 and rib 42 define a groove or channel 51 therebetween. Finally, an elongated bead 52, FIG. 7, also offset from wall portion 26 forming channel 53, extends downwardly from partition 20.

All of the foregoing parts of base section 11 may be formed from a single sheet of extruded material, such as lightweight aluminum.

Elongated panel sections may now be assembled to the foregoing parts of base section 11. Thus, as seen in FIGS. 1 and 2*b*, a planar elongated flat removable panel section 54 is provided closing off chamber 24. Panel section 54 has inwardly extending flanges 55, 56 at the top and bottom respectively with grooves 57, 58, respectively, receiving therein beads 48, 41, respectively. As clearly seen in FIG. 2*b*, flange 55 has an enlarged angled portion 59 underlying partition 21, partition 21 bearing thereagainst. The portions of flanges 55, 56 on the outside of panel section 54 ride in respective channels 50 and 60, the latter being formed by bead 41 which is offset as shown. Thus, in assembling panel section 54 to base section 11, the ends of base sections ll and 12 (or at least one end thereof - FIG. 3) prior to securement of frames members 72, as will be discussed, and corner members 13 and end sections 14, 15 thereto is open with panel section 54 slid into the position shown in FIG. 2*b*.

Figure 7:
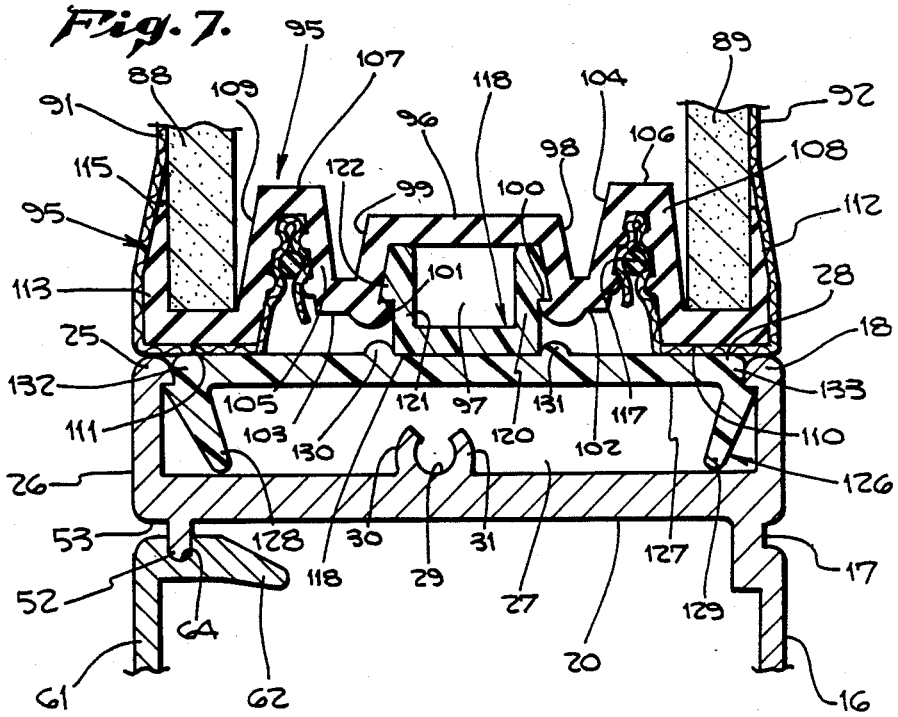

A like planar panel section 61 (FIG. 2*b*) is provided also having inwardly extending upper and lower horizontal flanges 62, 63, respectively, with grooves 64, 65, respectively, receiving therein beads 52, 47, respectively (see also FIG. 7). The outer portions of flanges 62, 63 ride in channels 53, 49, respectively.

Although a single panel section 54 is shown closing off chamber 24, a plurality, such as three, panel sections 61, 66 and 67 (FIG. 1) may be provided closing off chamber 23, the overall length of sections 61, 66 and 67 being the same as the overall length of section 54. Sections 61, 66 and 67 are identical in structure and assembled to base member 11 in an identical manner. However, one of the sections 61, 66 and 67, such as section 66 (FIG. 1), may be of a shorter length than the other sections 61, 67 (or the same or greater length) but, more importantly, may include suitable connectors for electronic equipment. For example, as seen in FIGS. 1 and 5 and in dotted lines in FIG. 2*b*, a conventional RF connector 68 extends from panel section 66 and a conventional telephone jack 69 also extends from panel section 66. These connectors 68, 69 are in turn coupled to suitable electrical conduits (not shown) extending within chamber 23 to suitable sources of power. These panel sections 54, 61, 66 and 67 may be made of the same material as the remainder of base section 11, such as lightweight aluminum. Sections 61, 66 and 67 may be formed by cutting a single sheet of extruded aluminum, such as panel section 54, to desired lengths. That is, connector 68 and jack 69 may be on section 61 or 67, if desired, and the section bearing such connector 68 and jack 69 may be located at any desired location along base section 11 by merely interchanging panel sections 61, 66 and 67 or cutting the panel sections any desired lengths.

As seen in dotted lines in FIG. 2*b*, an electrical connector box 70 is provided internally of chamber 24. These boxes are well-known in the electrical art and are adapted to be coupled to suitable conduits (not shown) for carrying current through the base sections 11, 12. For example, conventional boxes manufactured by AMP may be used.

As seen in FIG. 2*b*, a resilient strip 71, of rubber or any suitable material, is provided within chamber 24 disposed in groove 38 and similarly configured. Box 70 has upwardly and downwardly extending flanges, such as spaced upper flanges 72', 73 and spaced lower flanges 74, 75, which may be rounded at their ends, which ride in grooves 51 and 38, respectively. The resiliency of strip 71 allows the box 70 to be inserted into chamber 24 through one open end of base member ll, as discussed hereinabove prior to assembly of frame members 24, corner members 13 and end sections 14, 15 with flanges 72', 73 entering groove 51 and flanges 74, 75, deforming strip 71 and entering groove 38. This resiliency of strip 71 allows box 70 to be snap-fit into tracks or grooves 51, 38 and be movable along the same but held in position.

Since grooves 29, 32 are formed at each end of base member 11, the base member 11 can be used in either orientation (groove 29 up or down). The vertical heights of chambers 23, 24 may differ, if desired.

Figure 4:
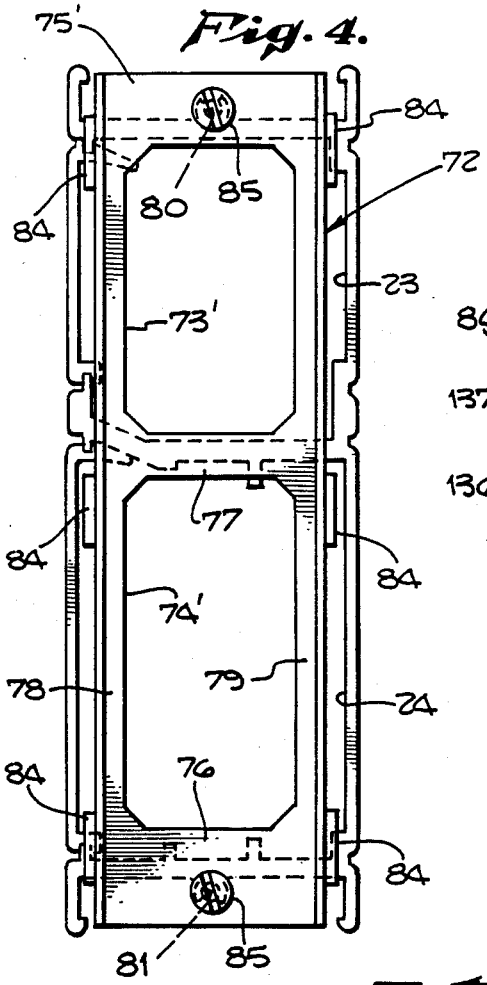
FIG. 4 is a view taken, along lines IV—IV of FIG. 3.

As seen in FIG. 4, the free open ends of each base section 11, 12 are closed off by interlocking frame members 72. Each frame member 72 is a generally elongated rectangular member having open upper and lower cut-out sections 73', 74', respectively. These sections 73', 74' are of any desired configuration and provide communication with the interiors of chambers 23, 24, respectively. Each frame member has an upper cross member 75' and a lower cross member 76 with a mid cross-member 77. These members 75', 76 and 77, along with elongated side members 78, 79, define cut-out sections 73', 74, as shown. A hole 80 is provided at the midpoint of upper cross-member 75' (see also FIG. 3) and a like hole 81 is provided at the midpoint of lower cross member 76 (see the dotted lines in FIG. 4).

Figure 3:
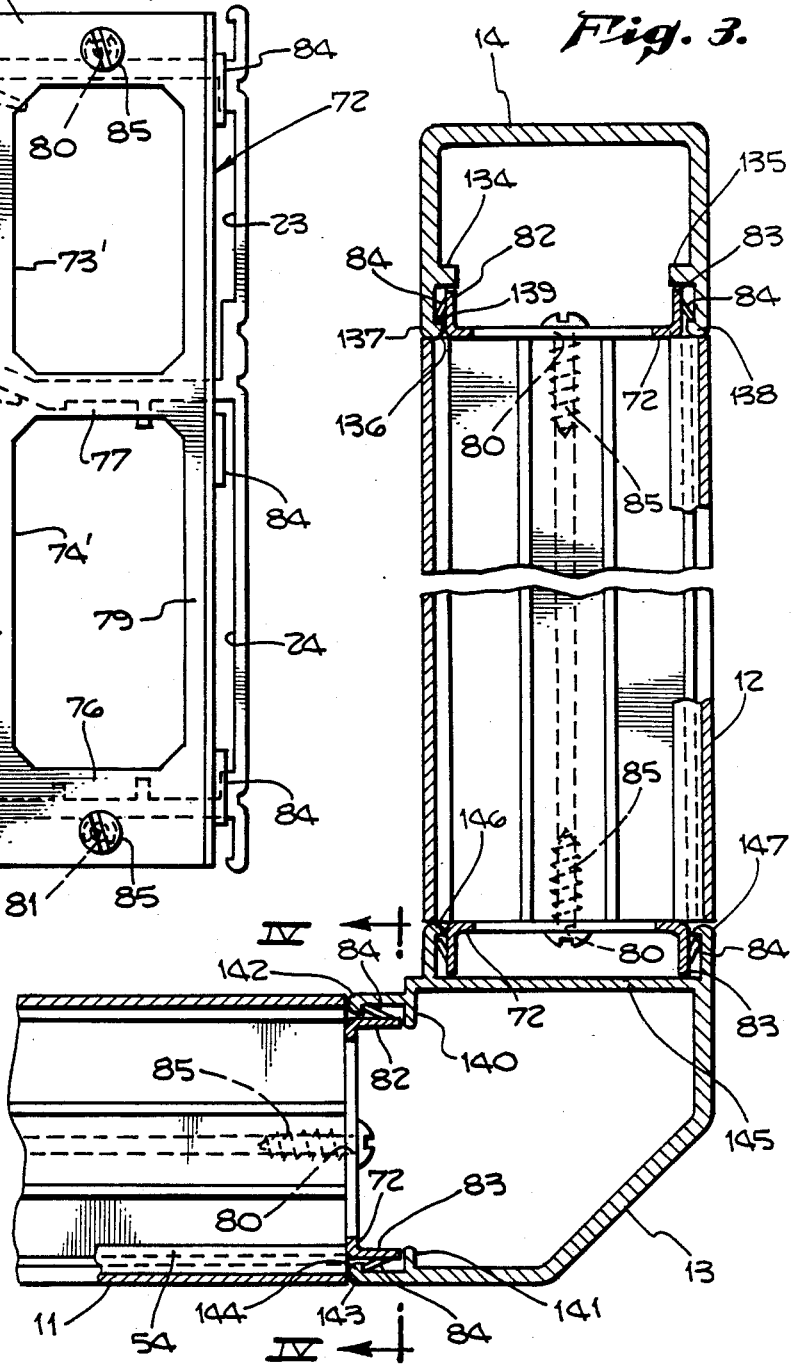
FIG. 3 is a sectional view taken along lines III—III of FIG. 1.

As seen in FIG. 3, these frame members 72 are U-shaped in cross-section forming side flanges 82, 83 (FIG. 3) which extend outwardly and away from base section 11, 12 when frame members 72 are assembled to base sections 11, 12. These frame members 72 also have a plurality of spaced outwardly extending ears 84 extending along both sides of side members 78, 79 and preferably punched out of the same material thereof (such as any suitable metallic material). The utility of these ears 84 will be explained further hereinbelow. In any event, these frame members 72 are assembled to the base sections 11, 12 by screws 85 which are conventional screw threaded screws of a metallic material which enter grooves 29, 32 and bite into the material of sections 11, 12. The openings 73', 74 thus coincide with the openings leading into chambers 23, 24, respectively. Assembly 10 further includes panel sections 86, 87 (see particularly FIGS. 1, 2*a* and 2*b*) which panel sections 86, 87 are structurally identical but may vary in width. In any event, as seen in FIG. 2*a*, each panel section, such as panel section 86, includes a pair of spaced flat planar members 88, 89, of any suitable material, such as wood, which may be interconnected by a plurality of spaced connecting strips 90 (see also FIG. 2*b*). Each planar member 88, 89 is covered on the outside by a suitable fabric material 91, 92, respectively.

Figure 6:
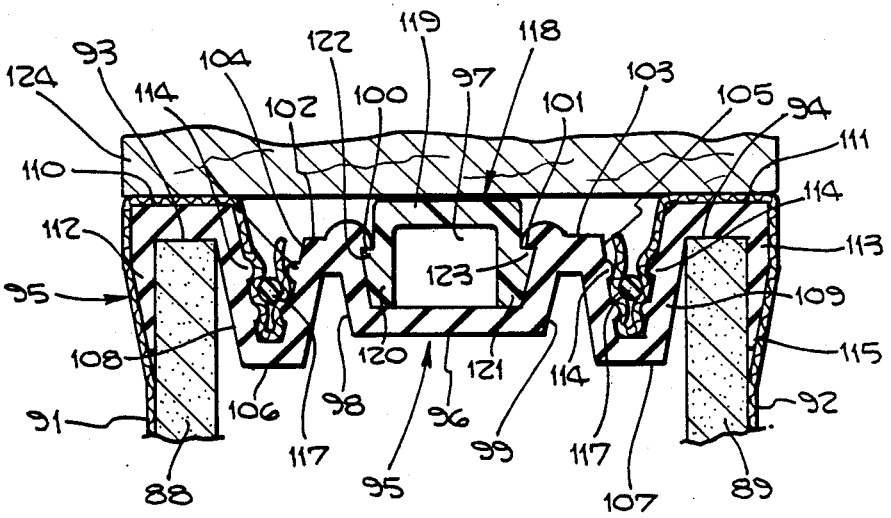
FIGS. 6 and 7 are detailed views of portions of the view shown in FIGS. 2*a* and 2*b*, respectively.

Combination fabric retainer and connecting members 95 are provided for retaining fabric material 91, 92 to the planar members 88, 89 and for connecting the fabric covered planar members, as a single panel section, to the assembly 10. These members 95 are as long as the sides of the panel sections 86, 87 extending the full length thereof. As seen in FIGS. 6 and 7, each member 95 includes a central portion 96 forming an elongated longitudinally extending channel 97 generally rectangular in cross-section. The sides 98, 99 of channel 97 flare slightly outwardly terminating at raised and inwardly extending ridges 100, 101, respectively. Flat portions 102, 103 extend from ridges 100, 101, then downwardly and slightly outwardly at flared sides 104, 105, respectively. Sides 104, 105 terminate at flat portions 106, 107, respectively. Flared sides 108, 109 extend upwardly and outwardly from flat portions 106, 107, respectively, terminating at upper flat portions 110, 111, respectively. Outer side members 112, 113 extend downwardly from flat portions 110, 111, respectively. A plurality of spaced elongated ribs or ridges 114 may be provided on sides 104, 105, 108, 109 as shown. The terminal ends of side members 112, 113 may taper to a blunt edge 115. The planes of central portion 96, flat portions 106, 107, 110 and 111 may all be generally parallel to each other. The material of connecting member 95 may be of any suitable material but preferably of a resilient material so that it can be snapped over the ends 93, 94 of planar members 88, 89, respectively, with the fabric material 91, 92 trapped therebetween as shown. The fabric materials 91, 92, as seen in FIGS. 6 and 7, pass over the outside of connecting members 95 along walls 112, 113, over flat portions 110, 111, down along flared portions 108, 109 and into the valley formed between flared portions 108, 104, and 109, 105 where the free ends are retained therein by a resilient molding strip 117 as is well-known in the screen art. The panel sections 86, 87 can thus be preassembled and finished off along the sides by the connecting members 95.

These connecting members 95 are adapted to be snap-fit onto U-shaped connector strips 118. As seen in FIGS. 6 and 7, these strips 118 are generally U-shaped in cross-section, each including a flat elongated main body portion 119 having a pair of integral spaced side members 120, 121 forming a central cavity which is generally rectangular in cross-section and, when assembled, coincides with channel 97 in connecting member 95. Ribs 122, 123 extend longitudinally along the outer surface of each side member 120, 121, respectively, forming shoulders as will be discussed. These ribs 122, 123 extend from the terminal ends of the side members 120, 121 a short distance transverse to the central axis thereof and are tapered on the outer surface conforming generally to the taper of sides 98, 99.

As seen in FIG. 1, the top surface of the assembly 10 is finished off by rails 124, 125. These rails 124, 125 may be of any suitable material, such as wood, and, as seen in FIG. 2*a*, are snapped onto the connecting members 95. This is accomplished by gluing or otherwise cementing the main body portion of strip 118 to the underside of rail 124. The side members 120, 121 extend toward connecting member 95 and enter into chamber 97, the shoulders formed by ribs 122, 123 snapping under beads 100, 101 thus retaining the rail 124 to the member 95 as shown. The outer side surfaces of rail 124 are flush with the outer side surfaces of panel sections 86, 87 thus forming a neat and pleasing appearance.

The connection of the lower end of panel section 86 to the base section 11 is a little different. As seen in FIGS. 2*b* and 7, a U-shaped connector member 126 is provided having a main planar body section 127 (FIG. 7) and a pair of spaced downwardly and inwardly extending side sections 128, 129. A pair of spaced ribs 130, 131 are provided on the outer surface of body section 127 and connector strip 118 is glued or cemented or otherwise secured to body section 127 between ribs 130, 131. A pair of shoulders 132, 133 are formed at the junction of side sections 128, 129 with main body section 127 and these shoulders 132, 133 snap-fit into and engage bead 25 on wall portion 26 and bead 18 on the upper edge of wall 16. The side sections 128, 129 act as support legs resting on partition 20. In this manner, with connecting strip 118 pre-glued or the like to connector member 126, this assembly being mounted into channel 27 as shown in FIGS. 2*b* and 7, the lower end of the preassembled panel section 86 can be quickly and easily snap-fit via connecting member 95 to strip 118.

As seen in FIGS. 1 and 3, the side vertical end sections 14, 15 are generally hollow and rectangular in cross-section. However, they can be solid except as otherwise discussed and may be of any suitable material, such as lightweight aluminum. Corner section 13 is irregularly shaped in cross-section so that it can be connected to both base sections 11 and 12. All three sections 13, 14, 15, however, have the same interconnecting means for interconnecting the same to the remaining structure of assembly 10. Also, it is to be understood that, prior to connection of sections 13–15, the end surfaces of assembly 10 terminate in the same vertical plane so that, for example, end section 14 snap-fits onto the exposed open end of base section 12 after assembly of strip 72 thereto as seen in FIG. 3 and the outer vertical edge of panel section 87 (panel section 87 having connector members 95, 118 and 126 installed thereon as seen in FIG. 2*b*).

Thus, looking at end section 14 in FIG. 3, section 14 includes a pair of inwardly extending flanges 134, 135 spaced from the open end 136 thereof. At the open end, a pair of inwardly extending enlarged beads 137, 138 define the open end 136. These beads 137, 138 are preferably rounded on their outer surfaces as shown and the spacing therebetween is generally related to the outer diameter of flanges 82, 83. In assembling end section 14 to base member 12, the rounded surfaces of beads 137, 138 ride over the tapered outer surfaces of tangs or ears 84 until they move therepast and snap thereunder, the terminal inner ends of said tangs or ears 84 engaging flat portions 139 on beads 137, 138. This engagement is such that the end section 14 is snapped onto base section 12 in a direction parallel to the central axis thereof, retained thereto, but easily removed by pulling in the opposite direction. The free ends of flanges 82, 83 abut against flanges 134, 135.

The end section 14 is of course elongated and extends the vertical length of panel section 87 as seen in FIG. 1. The beads 137, 138 are identical to beads 18, 25 (FIG. 2*b*) and snap over side sections 128, 129 of connector member 126 into shoulders 132, 133 (FIG. 7) to retain end section 14 to panel section 87.

End section 15 is identical to section 14 and assembled to base section 11 and panel section 86 in like manner. Corner section 13 of course snaps onto the free ends of both base sections 11, 12 and panel sections 86, 87. Corner section 13 thus has spaced inner flanges 140, 141 (similar to flanges 134, 135) and beads 142, 143 (identical to beads 137, 138) defining open end 144. As seen, beads 142, 143 move over tangs or ears 84 and snap-fit into position as shown.

The opening between flanges 140, 141 is such that suitable electrical conduits (not shown) can pass therethrough and up through corner member 13. Of course, if desired, a flange 145 may extend all the way across closing off the interior of corner member 13 as seen in FIG. 3. However, beads 146, 147 are again identical to beads 137, 138 and move over tangs or ears 84 and snap into position. Of course, as seen in FIG. 1, the corner member 13 extends the full vertical length of panel sections 86, 87 and snaps into engagement therewith (to connecting members 95, 118, 126) as heretofore described with respect to end sections 11, 12.

The assembly 10 is now complete. The intersecting corners may be beveled or otherwise interconnect, such as the engagement of upper rails 124, 125, to provide a clean appearance. Wood trim may be used and any suitable materials may be used. The entire assembly 10 may be quickly and easily set up and taken down. Of course, the assembly 10 may be of any suitable dimensions and configuration. That is, an entire vertical linear wall assembly may be provided with end sections 14 and 15 (or at least on the exposed ends) and, obviously no corner units.

The base sections 11, 12 thus may be elongated extruded members cut to the desired length, having two elongated areas from which the panel sections 54, 61, 66 and 67 can be snapped out. A modular section 66 is provided having a built-in telephone jack, RF connector, RS232 computer connector, etc. This section 66 can be at any desired location along the upper area merely by cutting the panel sections 61, 67 on each side to the desired length. The bottom elongated area has a channel 38 in the interior along the middle bottom with a neoprene strip 71 therein and a track 51 at top. This allows one to snap a conventional power junction box 70 into the channel 38 and track 51 as shown. The various wires go from the electronic devices out the side of the base sections 11, 12 and up through the side members to the ceiling panels.

There is thus discussed a unique wall system which can be quickly and easily set up or taken down. The base sections are quite versatile and can accommodate placement of conventional telephone and computer outlets, or electrical outlets, where desired. Extruded aluminum can be used throughout, cut to desired size and the ends, tops and corners are finished off by decorative parts.

I claim:

1. In a knock down wall assembly comprising:

at least one elongated base section (11 or 12), said base section (11 or 12) having a planar rear wall (16), a top partition (20) and a bottom partition (22), said base section (11 or 12) being normally open at each end and divided internally into at least a pair of elongated upper and lower chambers (23) (23) normally open along the side thereof opposition said rear wall (16) separated by a partition (21), said upper and lower chambers (23) (24) being normally open on the side of said base section (11 or 12) opposite said rear wall (16), a pair of elongated tracks (50, 48; 60, 41; 52, 53; and 47, 49 extending along top and bottom of the normally open side of each of said chambers (11, 12), a removable elongated planar panel snapfitting into top and bottom tracks formed at the top and bottom of one of the normally open sides of one of said chambers (23 or 24) closing off substantially the entire normally open side thereof, a first removable elongated planar panel section (61 or 67) snap-fitting into top and bottom tracks formed at the top and bottom of said normally open side of the other of said chambers (23 or 24), and at least a second removable elongated planar panel section (66) snap-fitting into the top and bottom tracks of said normally open side of the other of said chambers adjacent said first panel section (61 or 67), said second panel section (66) having at least one conventional electronic apparatus female connector (68 or 69) therein opening away from said second panel section.

2. In the assembly of claim 1 wherein the overall height of one of said chambers is less than the overall height of the other of said chambers.

3. In the assembly of claim 1 including a third removable elongated planar panel section snap-fitting into the top and bottom tracks of said open side of the other of said chambers adjacent said second panel section, the overall length of said first, second and third panel sections closing off substantially the entire open side of said other of said chambers.

4. In the assembly of claim 1 including a first elongated track on the undersurface of said partition (21) opening into the other of said chambers extending along substantially the center axis thereof and a second elongated track on the inner surface of said bottom partition (22) opening into the other of said chambers extending along substantially the center axis thereof, an elongated resilient pad extending along and within said last-mentioned track and a conventional electrical connector box having upper and lower flanges snapfitting into said last-mentioned two tracks, said box being resiliently held therein and movable along said last-mentioned juxtaposed tracks.

5. In the assembly of claim 1 wherein said planar panel sections each have tracks extending along the upper and lower elongated edges thereof adapted to snap-fit into mating engagement with tracks of open sides of said chambers.

6. In the assembly of claim 1 including an elongated C-shaped groove extending along substantially the center axis of the upper surface of said top partition (20) and the undersurface of said bottom partition (22), each of said C-shaped grooves opening in a direction away from said base section and forming a generally round open ended channel therealong, and a generally rectangular frame member having a rectangular peripheral wall and a center flange separating said plate into a pair of open sections, a peripheral flange extending away from said peripheral wall in a direction generally normal with respect thereto along both vertical sides of said frame member, a pair of apertures extending through said plate along generally the central elongated axis thereof above and below each of said open sections, respectively, and fasteners extending through said apertures into said open ended channels of said C-shaped groove for retaining said frame member to said base section.

7. In the assembly of claim 6 wherein said C-shaped groove is of aluminum and said fasteners are metal screws extending through said apertures and into said channels of said C-shaped grooves biting into the material thereof.

8. In the assembly of claim 6 wherein the open sections of said frame member are aligned with the open ends of the chambers of said base section.

9. In the assembly of claim 6 including a plurality of spaced ears extending outwardly from said peripheral flange in a direction toward said base section.

10. In the assembly of claim 9 wherein said ears are tangs stamped out of the material of said peripheral flange.

11. In the assembly of claim 1 wherein said top partition (20) has outer linear edges and is defined by a pair of upstanding flanges extending along the outer linear edges thereof on both sides thereof forming a channel and a panel section comprised of a pair of spaced planar panel members snapfitting into said channel so that the vertical outside surfaces of said last-mentioned panel sections are substantially flush with the rear wall and the closed off chambers of said base section.

12. In the assembly of claim 11 including a shoulder formed on each of said upstanding flanges on the inner undersurfaces thereof, a U-shaped connector member having a planar main body surface with a pair of spaced downwardly and inwardly extending end flanges, a shoulder formed at the intersection of said spaced end flanges and said main body surface on the outside thereof, said last-mentioned shoulders snap-fitting into and under said shoulders on said upstanding flanges, a U-shaped elongated strip having a main body surface secured along generally the central axis of the upper surface of said main body surface with the legs thereof extending away therefrom, said legs having shoulders along the underside of the midportion of said legs on the outer surfaces thereof, said last-mentioned panel section having a connecting member secured thereto, said connecting member having spaced U-shaped channels on the outer elongated sides thereof receiving said spaced planar panel members therein, said U-shaped spaced channels being interconnected by an elongated central body portion forming an elongated channel, opening in a direction opposite that of said U-shaped channels, said elongated channel having shoulders formed along the inner surfaces of the walls forming said elongated channel, said shoulder on said legs snap-fitting into engagement with the shoulders of said elongated channel.

13. In the assembly of claim 12 including an elongated rail closing off the upper end of said last-mentioned panel section and snap-fitting into engagement therewith.

14. In the assembly of claim 13 including a U-shaped elongated strip having a main body surface secured along generally the central axis of the lower surface of said rail with the legs thereof extending away therefrom, said legs having shoulders along the underside of the midportion of said legs on the outer surfaces thereof, a connecting member secured to the upper end of said last-mentioned panel section, said last-mentioned connecting member having spaced U-shaped channels on the outer elongated sides thereof receiving the upper end of said spaced planar panel members therein, said last-mentioned U-shaped spaced channels being interconnected by an elongated central body portion forming an elongated channel, opening in a direction opposite that of said last-mentioned U-shaped channels, said last-mentioned elongated channel having shoulders formed along the inner surfaces of the walls forming said last-mentioned elongated channel, said last-mentioned shoulder on said last-mentioned legs snap-fitting into engagement with the shoulders of said last-mentioned elongated channel.

15. In the assembly of claim 9 or 14 including vertical end sections snap-fitting into engagement with said frame members.

16. In the assembly of claim 15 wherein each of said vertical end sections have elongated vertical flanges along each vertical edge thereof extending in a direction toward said respective frame member terminating at their forward ends in shoulders on the inner surfaces thereof, said last-mentioned shoulders snap-fitting into engagement with said ears on said frame member.

17. In the assembly of claim 16 including at least one inwardly extending flange on the inner vertical wall of each of said end sections extending in a direction normal to the direction of said last-mentioned vertical flanges, the overall width of said flanges of said frame member having said ears thereon being generally related to the spacing between said inwardly extending flange of said end section and the terminal end of said last-mentioned vertical flanges so that the terminal end of said flanges of said frame member abut against said inwardly extending flange when said end section is snap-fit into engagement with said frame member.

18. In the assembly of claim 16 wherein each of said elongated vertical sides of said last-mentioned panel section snap-fit into engagement with said respective end sections, each of said end sections channels being interconnected by an elongated central body portion forming an elongated channel, opening in a direction opposite that of said last-mentioned U-shaped channels, said last-mentioned elongated channel having shoulders formed along the inner surfaces of the walls forming said last-mentioned elongated channel, a U-shaped insert having a planar main body surface with a pair of spaced downwardly and inwardly extending end flanges, a shoulder formed at the intersection of said last-mentioned spaced end flanges and said main body surface on the outside thereof, said last-mentioned shoulders snap-fitting into and under the shoulders on said upstanding flanges of said end sections, a U-shaped elongated strip having a main body surface secured along generally the central axis of the upper surface of said last-mentioned body surface with the legs thereof extending away therefrom, said last-mentioned legs having shoulders along the underside of the midportion of said lastmentioned legs on the outer surfaces thereof, said shoulders on said last-mentioned legs snap-fitting into engagement with the shoulders of said last-mentioned elongated channel.

* * * * *